US009420898B2

(12) United States Patent
Schechtman

(10) Patent No.: US 9,420,898 B2
(45) Date of Patent: Aug. 23, 2016

(54) DECORATIVE STEP STOOL COVER

(71) Applicant: Adam Gey Schechtman, Seven Valleys, PA (US)

(72) Inventor: Adam Gey Schechtman, Seven Valleys, PA (US)

( * ) Notice: Subject to any disclaimer, the term of this patent is extended or adjusted under 35 U.S.C. 154(b) by 94 days.

(21) Appl. No.: 14/527,751

(22) Filed: Oct. 29, 2014

(65) Prior Publication Data

US 2015/0289671 A1 Oct. 15, 2015

Related U.S. Application Data

(60) Provisional application No. 61/977,752, filed on Apr. 10, 2014.

(51) Int. Cl.

| | |
|---|---|
| ***A47C 31/00*** | (2006.01) |
| ***A47C 7/62*** | (2006.01) |
| ***D05B 23/00*** | (2006.01) |
| ***D06C 23/00*** | (2006.01) |
| ***D06H 7/00*** | (2006.01) |
| ***D06Q 1/00*** | (2006.01) |
| ***A47C 31/11*** | (2006.01) |
| ***A47C 12/00*** | (2006.01) |

(52) U.S. Cl.

CPC ..... *A47C 31/11* (2013.01); *A47C 12/00* (2013.01); *D06C 23/00* (2013.01); *D06H 7/00* (2013.01); *D06Q 1/00* (2013.01)

(58) Field of Classification Search

CPC ..... A47C 31/11; A47C 31/10

USPC ..... 297/181

See application file for complete search history.

(56) References Cited

U.S. PATENT DOCUMENTS

| | | | | | |
|---|---|---|---|---|---|
| 3,008,763 | A * | 11/1961 | Lebow | A47B 85/04 | 297/181 |
| 3,737,196 | A * | 6/1973 | Bodor | A63H 3/02 | 297/181 |
| 4,676,551 | A * | 6/1987 | McDowell | A47C 9/00 | 248/188.9 |
| 4,712,833 | A * | 12/1987 | Swanson | A47D 1/004 | 297/219.12 |
| 4,909,573 | A * | 3/1990 | Barry | A47D 15/006 | 297/181 |
| 5,112,104 | A * | 5/1992 | De Giacomi | B60N 2/60 | 297/181 |
| 5,114,185 | A * | 5/1992 | Reedom | B60R 22/00 | 280/801.1 |
| D346,704 | S * | 5/1994 | Grosfillex | D6/349 | |
| 5,551,749 | A * | 9/1996 | Reher | A47D 15/006 | 297/181 |
| 5,683,137 | A * | 11/1997 | McDonald | A47D 15/00 | 297/188.09 |
| 6,126,240 | A | 10/2000 | Tse | | |
| 6,877,817 | B1 * | 4/2005 | Brown | A47C 16/02 | 297/461 |

(Continued)

FOREIGN PATENT DOCUMENTS

| | | | |
|---|---|---|---|
| CN | 203407793 | U | 1/2014 |
| CN | 302712807 | S | 1/2014 |

*Primary Examiner* — David R Dunn

*Assistant Examiner* — Tania Abraham

(74) *Attorney, Agent, or Firm* — Shifrin Patent Law; Dan Shifrin

(57) ABSTRACT

A decorative step stool cover is provided, comprising: a body having a substantially flat top surface, the top surface configured to cover a planar step surface of a single step stool and the body configured to overhang sides of the step stool; a head attached to a first end of the body; a tail attached to a second end of the body, opposite the head; four legs attached to respective corners of the body, each leg comprising a compartment configured to enclose a leg of the step stool; and means for removably securing the step stool cover to the step stool.

19 Claims, 6 Drawing Sheets

(56) References Cited

U.S. PATENT DOCUMENTS

| | | | | |
|---|---|---|---|---|
| 6,886,660 | B2 * | 5/2005 | Sapatova | A47C 12/02 182/228.2 |
| 7,207,627 | B2 * | 4/2007 | Jerome | A47C 31/02 297/219.1 |
| 7,481,491 | B1 * | 1/2009 | Diamantis | A47C 7/021 297/223 |
| 7,559,104 | B1 * | 7/2009 | Kahrig | A47D 13/08 297/181 |
| 7,743,916 | B2 * | 6/2010 | Roberts, II | A63B 55/00 150/159 |
| 7,854,476 | B1 * | 12/2010 | Liu | A47D 1/103 297/181 |
| 8,011,042 | B1 * | 9/2011 | Rose | A47C 7/021 297/219.1 |
| 2014/0015294 | A1 * | 1/2014 | Sadler-Vandeplas | A47D 15/00 297/219.12 |
| 2014/0252819 | A1 * | 9/2014 | Andrade | A47C 5/12 297/188.04 |

* cited by examiner

DECORATIVE STEP STOOL COVER

RELATED APPLICATION DATA

The present application is related to, and claims the benefit of, commonly-assigned and U.S. Provisional Application Ser. No. 61/977,752 filed on Apr. 10, 2014, which application is incorporated herein by reference in its entirety.

TECHNICAL FIELD

The present invention relates generally to step stools and, in particular, to a removable, decorative cover for a step stool, such as a child's single-step stool.

BACKGROUND ART

Step stools are commonly used throughout homes by toddlers and young children to reach items that are normally unreachable and to gain access to commonly used household utilities that are inaccessible without the help of an adult. Accessing sinks, countertops, toilets, shelves, cabinets, dresser drawers or closets are a few of the most common uses for step stools by children.

Traditional single-step step stools exist in multiple shapes, including animal shapes designed for children. These stools are predominantly constructed of hard materials such as wood, metal, plastic, or other polymeric materials. Such materials not only limit the decorative character of the stools, but also their comfort. For example, children with bare, cold feet due to cold weather or wet feet resulting from a bath, shower or swimming, can experience moderate discomfort standing on a hard stool. Many molded stools made of plastic or other polymeric materials incorporate a raised, slip-resistant pattern on the planar step surface to help feet grip the surface, however several of these stools are still potentially hazardous, particularly for children with wet feet, which can easily slip off of step stool's planar surface.

SUMMARY OF THE INVENTION

The present invention provides a decorative step stool cover. The cover comprises: a body having a substantially flat top surface, the top surface configured to cover a planar step surface of a single step stool and the body configured to overhang sides of the step stool; a head attached to a first end of the body; a tail attached to a second end of the body, opposite the head; four legs attached to respective corners of the body, each leg comprising a compartment configured to enclose a leg of the step stool; and means for removably securing the step stool cover to the step stool.

The present invention also provides a method of assembling a decorative step stool cover. The method comprises: cutting a body top cover flap, having a substantially flat top surface section, out of a first material, the top cover flap configured to cover a planar step surface of a single step stool and overhang sides of the step stool; cutting a cover bottom section out of a second material; forming a head section; forming a tail section; forming four legs, each leg comprising a compartment configured to enclose a leg of the step stool; forming an unfastenable seam between a portion of the perimeter of the top cover flap and a corresponding portion of the perimeter of the bottom section; securing the head section to a first end of the flat top surface section of the top cover flap; securing the tail section to a second end of the flat top surface section of the top cover flap opposite the first end; securing the four legs to respective corners of the bottom section; and securing means for creating a fastenable seam to remaining portions of the perimeters of the top cover flap and the bottom section

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
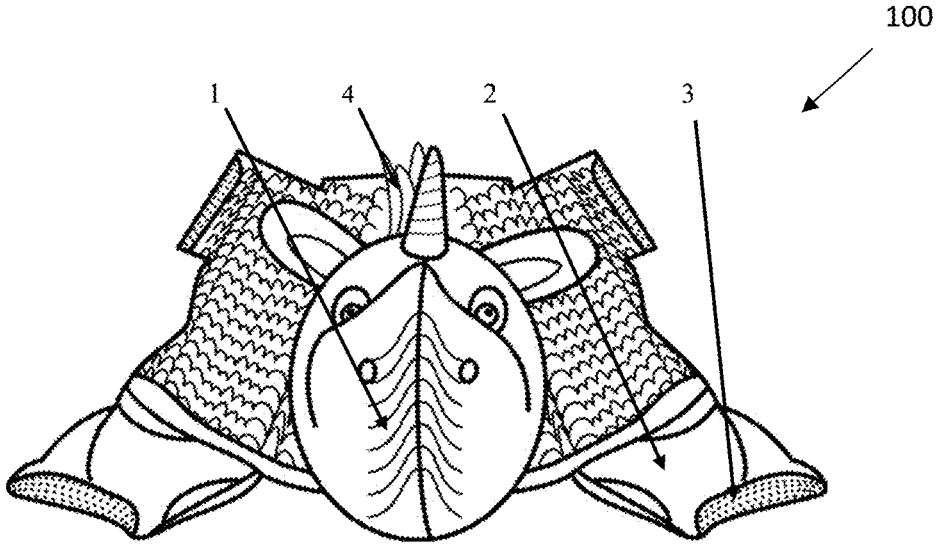
FIG. 1 is a front view of an embodiment of a decorative step stool cover of the present invention.
Figure 2:
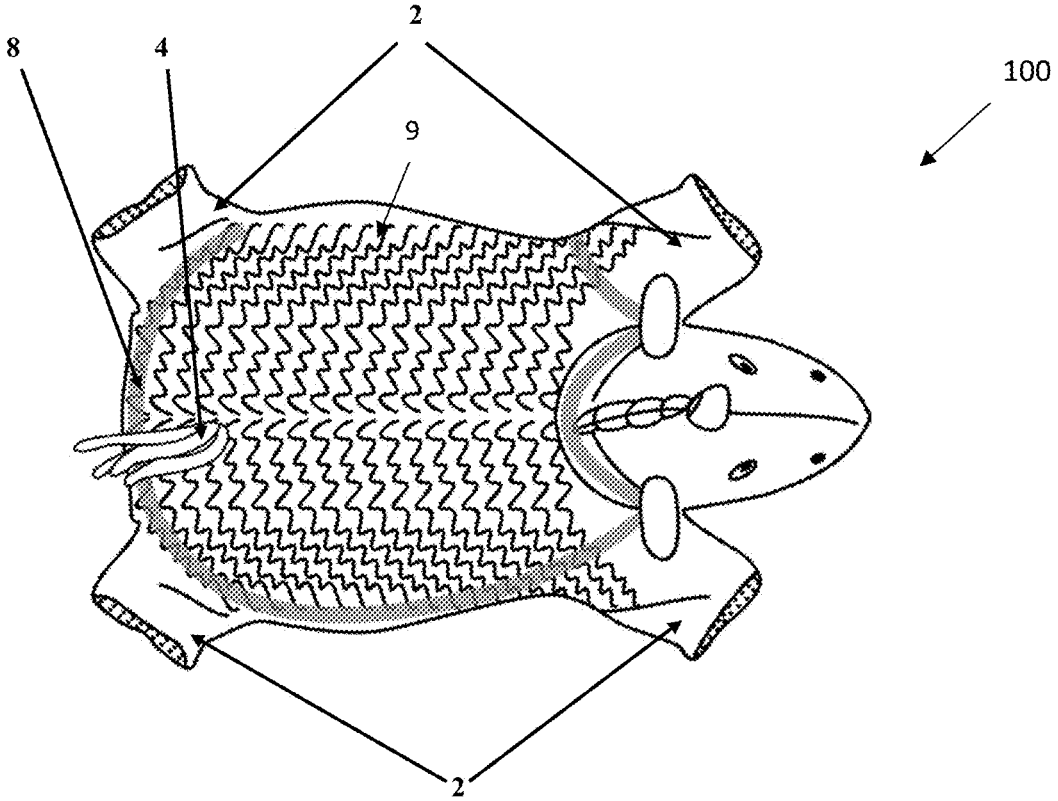
FIG. 2 is a top view of the decorative cover of FIG. 1.
Figure 5:
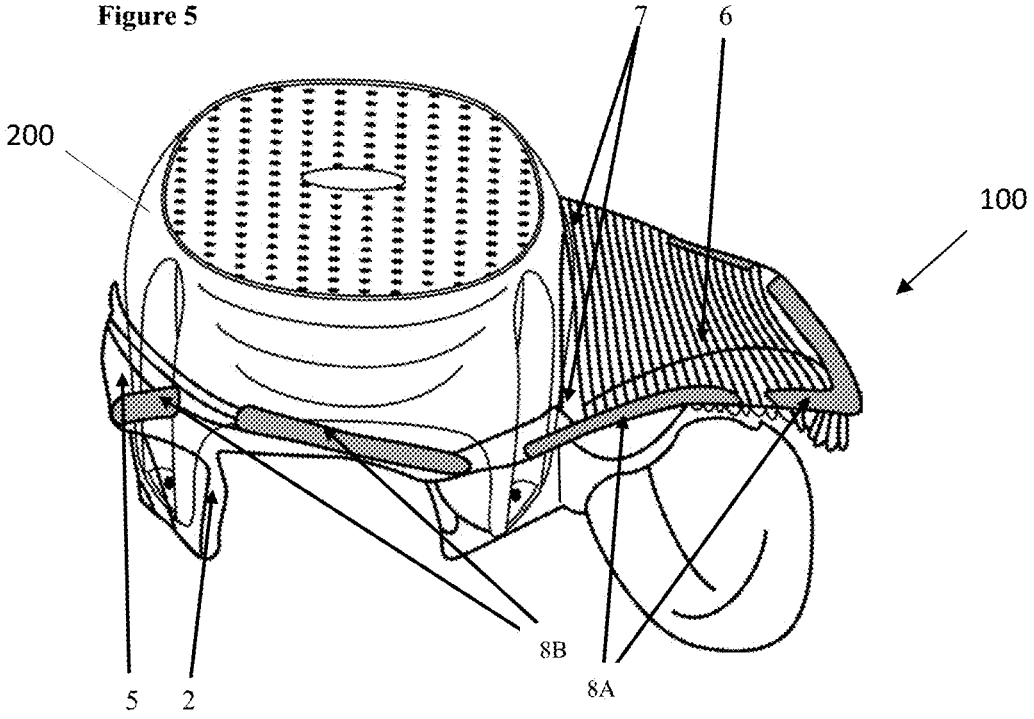
FIG. 5 is a transparent view of the step stool of FIG. 3 placed inside the decorative cover of FIG. 1.

FIGS. 1 and 2 illustrate one embodiment of a removable, once-piece decorative step stool cover (100) of the present invention having the appearance of a child-themed character, such as an animal with: a main body top cover flap (6) having a substantially flat top surface (9); a stuffed head (1) secured to one end of the top surface (9); legs (2) at the corners of the top surface (9); a tail (4) secured to the opposite end of the top surface (9) from the head (1); and a cover bottom (5). The top cover flap (6) and the cover bottom (5) are secured to each other along a portion of their respective perimeters, such as by sewing, to form an unfastenable or permanent seam (7). It will be appreciated that the cover (100) may have the appearance of any other character or item, real or imaginary, to appeal to children. At least the top cover flap (6), but also any other portion of the decorative cover (100), may be made using fabric such as chenille, silk, rayon, cotton, and/or other soft or plush material commonly found in bath mats, giving the planar step surface of the cover (100) similar drying and absorptive characteristics for children with wet feet as well as a softer, warmer tactile sensation for children with cold or bare feet. The cover (100) may be custom fitted to a rigid, single-step, step stool (200, FIG. 3), typically constructed or molded using light weight and high strength metal, plastic or other polymeric materials. FIG. 2 also shows strips of fabric hook and loop fasteners (8), such as Velcro® fasteners, on the inside of the cover (100). These fasteners (8), also depicted in FIGS. 5, 6 and 7, surround the remaining three sides of the inside perimeter of the top cover flap (6) (8A in FIGS. 5 and 7) and outside perimeter of the cover bottom (5) (8B in FIGS. 5 and 7) that are not secured with the unfastenable seam (7), thus forming a fastenable seam (10). The fastenable seam (10) allows the cover to be fastened around a standard, single step, step stool (200). In FIGS. 5 and 7, element 8A is used to identify the portion of the fastener material, such as hooks, affixed to the top flap (6) and element 8B is used to identify the portion of the fastener material, such as loops, affixed to the cover bottom (5); elements 8A and 8B are also collectively identified in other Figs. and in this description as element 8. While hook and loop fasteners are convenient to use, other types of fasteners may also be used to fasten the cover (100) to the stool (200), such as buttons, snaps, zippers, and clips, to name a few.

Figure 3:
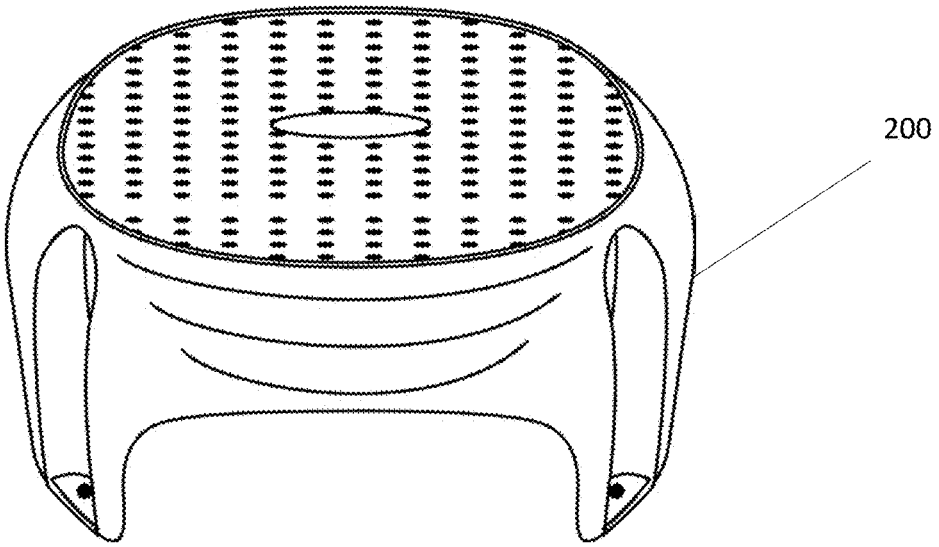
FIG. 3 is a top and side view of a traditional plastic molded, four-legged, single step, step stool that may be enclosed by the decorative cover of FIG. 1.

FIG. 3 is a two point perspective view of the top planar step surface and side of a traditional plastic molded, four-legged, single-step, step stool (200) that may be enclosed by the decorative step stool cover (100). The top step surface is typically approximately 14" wide by approximately 12" long.

Figure 4:
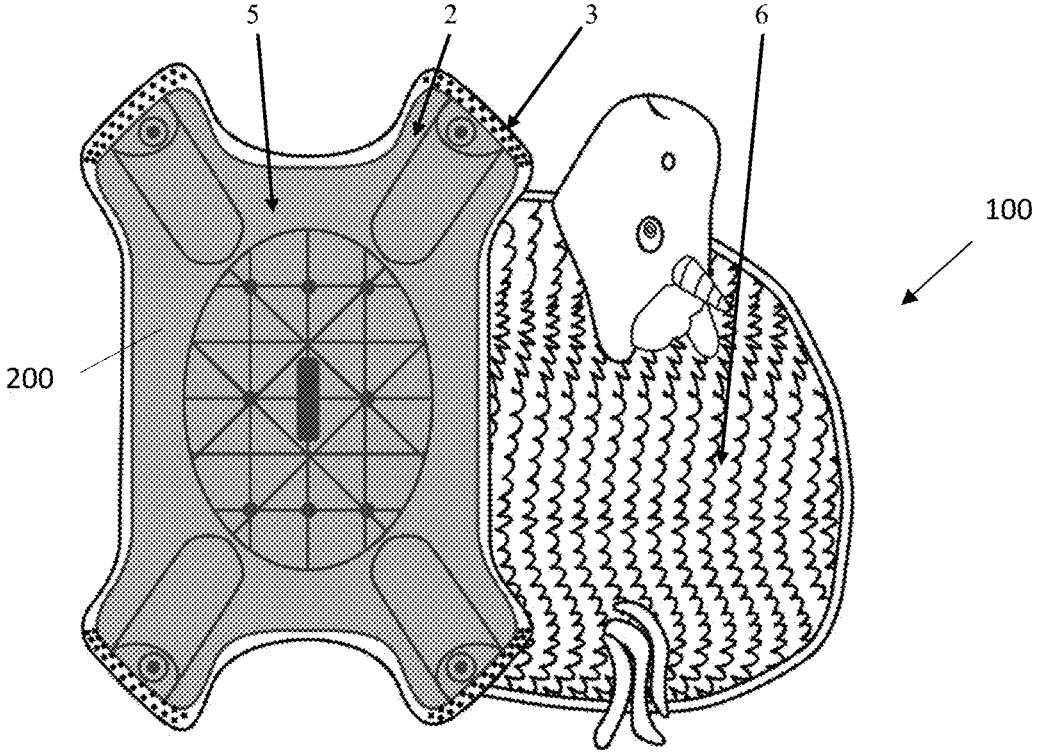
FIG. 4 is a transparent bottom view of the bottom, legs and feet of the step stool of FIG. 3 seated inside the legs, feet and bottom of the decorative cover of FIG. 1.

FIG. 4 shows a transparent view of the bottom of the step stool (200), with its four legs and feet seated inside the legs (2), feet (3) and bottom (5) of the decorative cover (100), seen in the left half of the illustration. The outside of the four feet (3) of the cover (100) may be made with PVC dot material, similar to those found on the footing of pajama "footies" or other skid-resistant material, making them slip-resistant and to reinforce the foot material. On the right half of the illustration is an open, top surface view of the flap (6) of the step stool cover (100), including the plush head (1) and tail (4), to be secured across the planar step surface of the step stool (200).

One possible sequence of how the decorative step stool cover (100) is constructed to enclose and fit snugly around the legs, feet, sides, planar step surface, and bottom surface of a step stool (200) appears in FIGS. 5, 6, 7 and 8.

As illustrated in FIG. 5, with the top cover flap (6) and cover bottom (5) fully open, the decorative cover (100) is ready to receive the step stool (200). Specifically, the left side of FIG. 5 is a transparent view of the step stool (200) placed inside the cover bottom (5), each of the four legs of the step stool (200) fitting within the four legs (2) legs and feet (3) of the cover bottom (5). On the right side of FIG. 5, the top cover flap (6) is affixed to the cover bottom (5) on one side at the unfastenable seam (7). FIG. 5 also shows a textured, slip-resistant material that may be used on the inside of the top cover flap (6), helping to minimize slippage between the planar surface of the step stool (200) and the cover (100).

Figure 6:
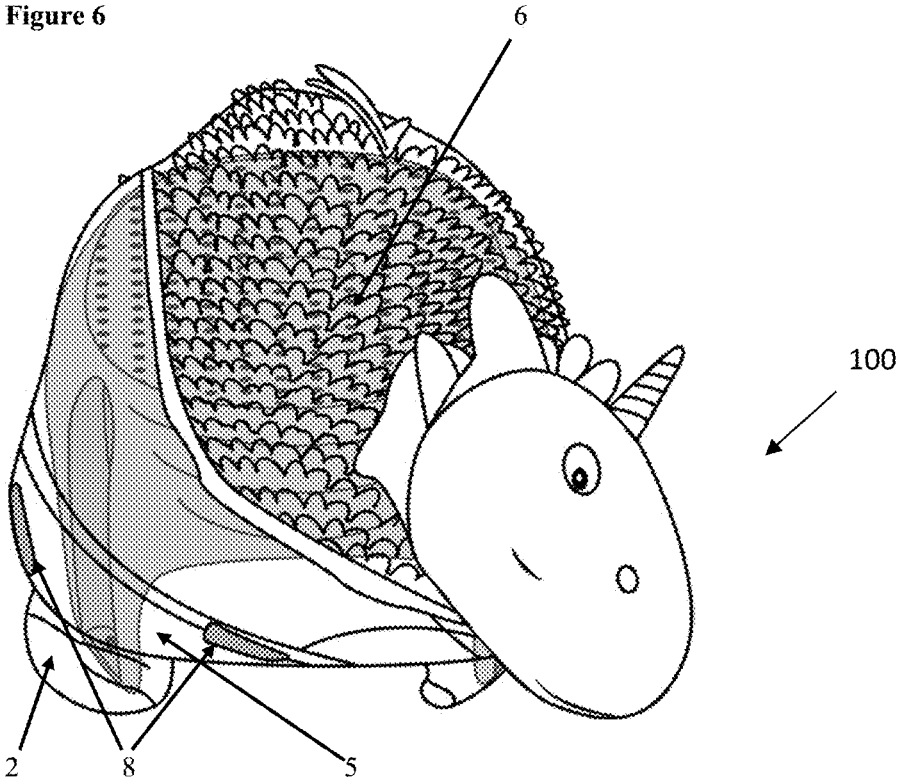
FIG. 6 is a transparent front and planar surface view of the step stool of FIG. 3 placed inside the decorative cover of FIG. 1.
Figure 7:
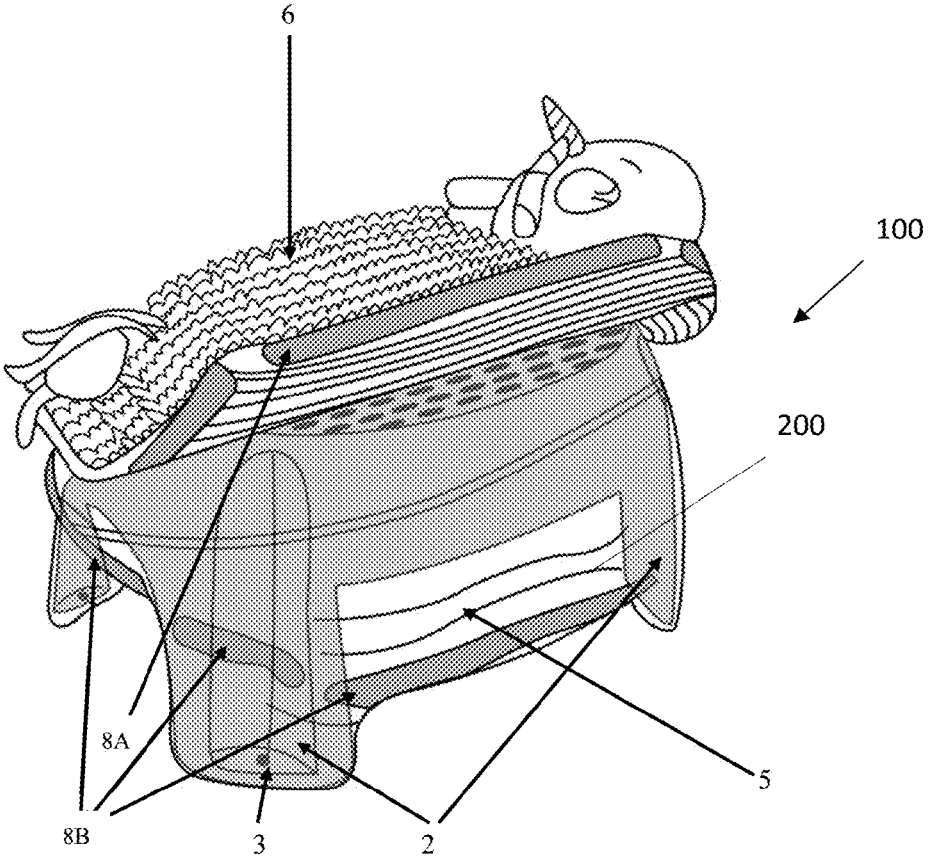
FIG. 7 is a partially transparent, three-point perspective view of the rear, side, and planar step surface of the step stool of FIG. 3 partially enclosed by the decorative cover of FIG. 1.
Figure 8:
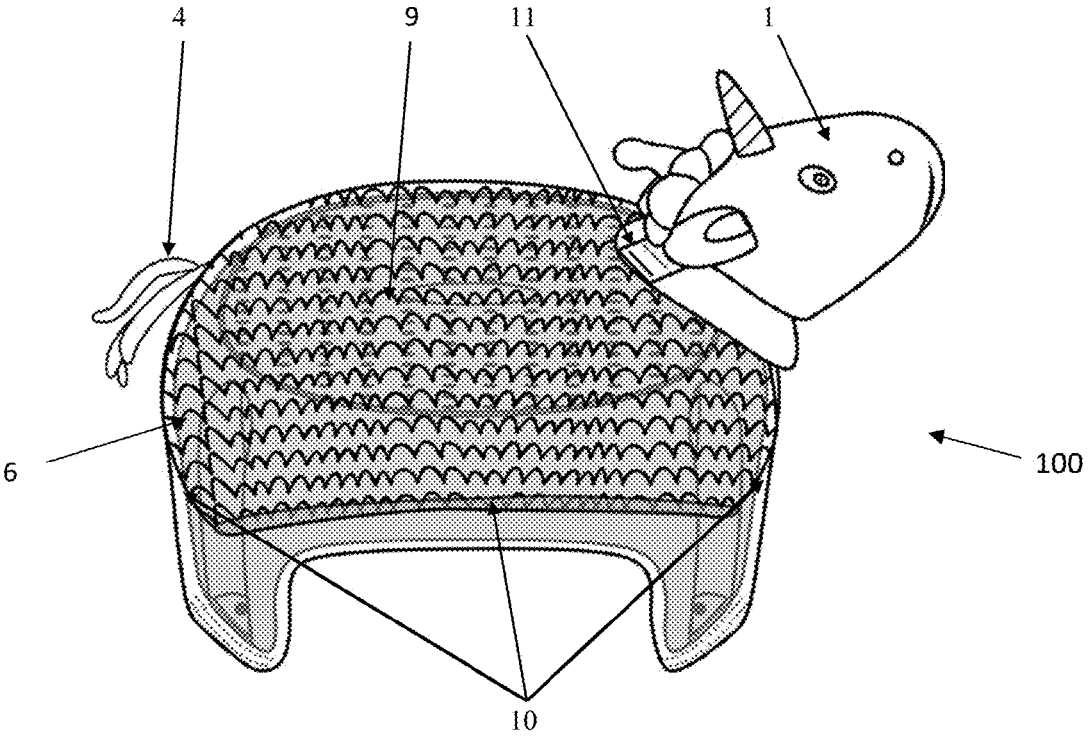
FIG. 8 is a two-point transparent perspective of a side surface and planar step surface of the decorative cover of FIG. 1 completely enclosing the step stool of FIG. 3.

Turning to FIGS. 6 and 7, after the legs of the stool (200) have been inserted into the legs (2) of the cover bottom (5), the top cover flap (6) is folded over the step surface of the stool (200). Then, the fasteners (8A, 8B) may be joined to form a closure for the cover (100) in the form of the fastenable seam (10) formed by the joined fasteners (8) and the sewn unfastenable (permanent) seam (7), as illustrated in FIG. 8. The cover (100) may thus be removed by separating the fasteners (8) and removing the stool (200) for cleaning and/or exchanging it with other covers, to provide, for example, a child with a changing variety of covers.

The process by which the decorative cover (100) is secured over and around the step stool (200) is also illustrated in the front view shown in FIG. 6. Once the step stool (200) has been placed into the cover bottom (5) and each of the legs (2), the cover flap (6), including head (1) and tail (4), is pulled over and across the planar step surface of the stool (200). The fasteners (8) may then snugly secure the cover flap (6) to the cover bottom (5).

FIG. 7 is a partially transparent, three-point perspective view of the rear, side, and planar step surface of the step stool (200) partially enclosed by the decorative step stool cover (100). Specifically, a side, rear and top view of the unfastened decorative step stool cover (100) with the cover flap (6) almost completely folded over the planar step surface of the step stool (200) is shown. The top surface (9) of the cover flap (6) has dimensions that are substantially similar to the top of the planar step surface of the step stool (200) and, therefore, rests on top of and covers the planar step surface. The cover bottom (5) with fasteners (8B), legs (2), and feet (3) wrap around the underside, legs and feet of the step stool (200), meeting the top cover flap (6) with the fasteners (8A), which in this view are visible along the underside edges of the top cover flap (6) and around the rear of the stool (200). These joined fasteners (8A, 8B), along with those below the neck to secure the cover front, form a complete closure in the form of a partially fastenable and partially unfastenable seam (10, 7), which is shown fully fastened in the side perspective in FIG. 8. The one-piece flap configuration with affixed stuffed head (1) and tail (4) appendages at the front and rear of the top cover flap (6), ensures that the appendages will not interfere with the legs or the planar step surface and that the step surface remains level.

FIG. 8 displays the complete, combined elements of the decorative step stool cover (100) fully enclosing the step stool (200). More specifically, FIG. 8 is a transparent top and side view of the of the decorative step stool cover (100) completely enclosing a single-step, four-legged molded step stool (200) with a visible nametag holder (11) and sample nametag attached across the top of the neckline of the cover (100). It will be appreciated that the top of the neckline of the cover (100) is only one possible location for the nametag holder (11). When the fasteners (8) are fully secured, the top cover flap (6) closure extends from the rear/back of the step stool cover (100), along the right side and around the front of the step stool cover (100) and under the neckline, creating a 3-sided partially fastenable and partially unfastenable seam (10, 7) to secure the cover (100) snugly around the around the planar step surface, legs and entire stool (200). The seam (10) can now be opened and closed for simple removal of the cover (100) for washing or interchanging with other covers. Further, this embodiment of the step stool cover (100) configuration attractively simulates animals or characters in their natural quadruped stance.

Figure 9:
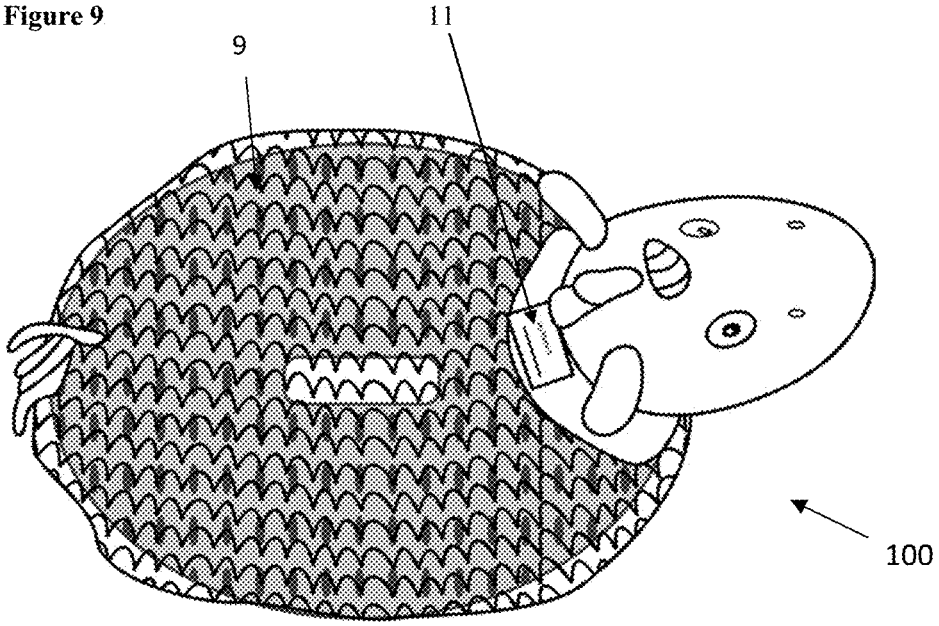
FIG. 9 is a top transparent view of the planar step surface of the step stool of FIG. 3 completely enclosed within the decorative cover of FIG. 1.
Figure 10:
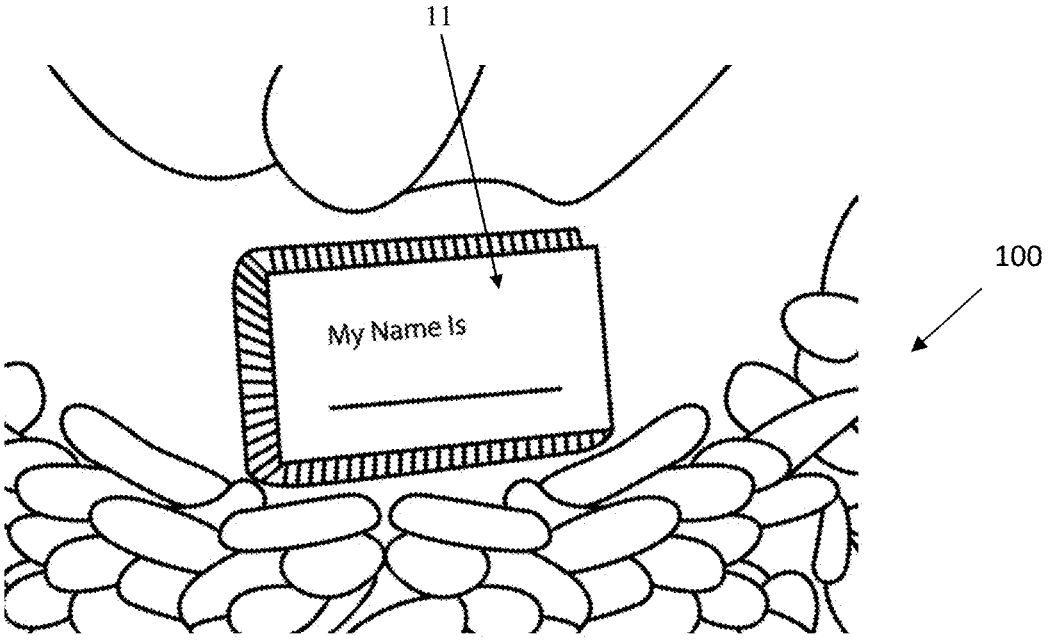
FIG. 10 is a close up view of a nametag holder which may be secured to the decorative cover of FIG. 1.

FIG. 9 is a top transparent view of the single-step, four-legged planar step surface of the step stool (200), completely surrounded by the decorative step stool cover (100). Also visible is the attached nametag holder (11) and sample nametag secured across the top of the neckline of the cover (100). FIG. 10 is a close-up view of the built-in nametag holder (11) and sample nametag along the neckline of the decorative cover (100). In one embodiment, the nametag holder (11) may measure approximately 2" long×1¼" wide. The nametag holder (11), having a transparent plastic cover, may be sewn to the decorative cover (100) on three sides while remaining open on one side in order to receive a personalized nametag made of paper, plastic or other printable material that can be decorated. The sample nametag shown within the holder (11) is approximately 1 1/16" wide×1 15/16" long.

Figure 11:
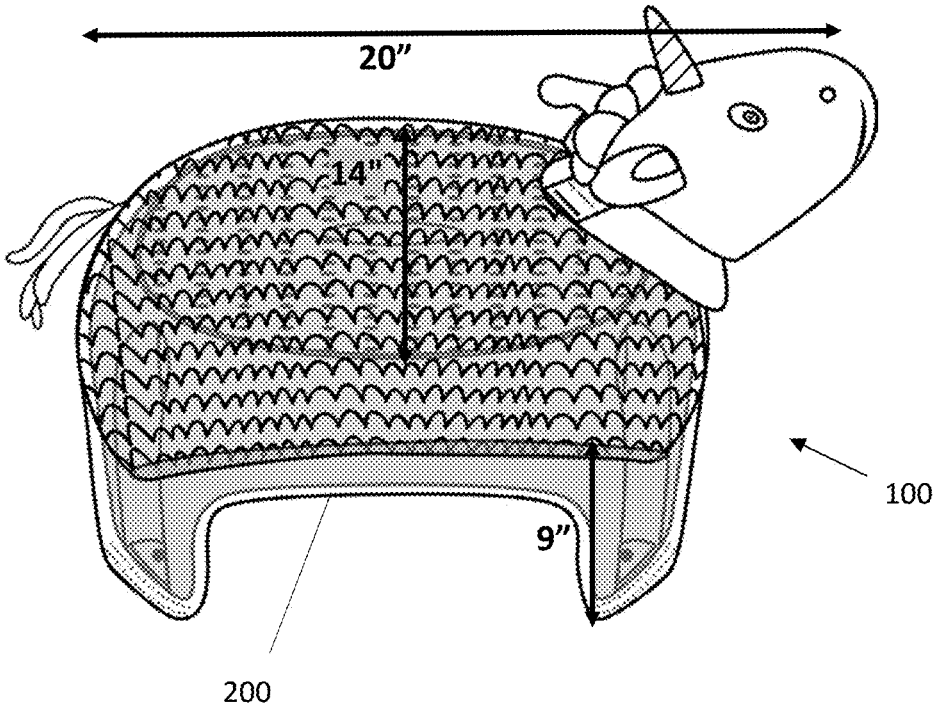
FIG. 11 shows an example of approximate dimensions of the step stool of FIG. 3 when enclosed by the decorative cover of FIG. 1.

FIG. 11 includes illustrative, but not definitive, dimensions of one embodiment of the step stool cover (100) enclosing a standard molded, single-step, step stool (200). The cover (100) is approximately 20" in length from the tip of nose of the head (1) to the tail (4) at the rear, approximately 12" wide by approximately 13½" long on the planar surface, and approximately 9" tall (from the bottom of the feet (3) to the planar step surface).

A separate collar with nametag holder or sewn-in collar with a nametag holder and/or a customizable nametag, encircling the neck area of the cover (100), that can be written on, colored, painted or otherwise decorated, may serve as an alternative nametag device for the user to personally customize. A decorative nameplate made of plastic, metal or other hard materials or made of materials that can be stamped, written on, colored, painted or otherwise decorated may also be attached to the cover and serve as an alternative to nametag holder (11) described and illustrated herein. The nametag holder may also be secured in such a way as to allow for a nametag to be received from the any side.

The one-piece cover (100) with partially fastenable and partially unfastenable seams (10, 7), including the top cover flap (6) with a stuffed head (1) and tail (4) configuration, allows for easy removal and interchangeability of the plush decorative cover. In an alternative embodiment, the step stool cover (100) may be permanently secured around the step stool (200). Thus, embodiments of the decorative step stool cover (100) of the present invention offer a novel, comfortable, personalizable children's step stool with interchangeable plush animal or other character designs. The combination provides many characteristics offered by a traditional stuffed animal toy, including companionship, playfulness, emotional comfort, friendship and security, along with practical characteristics offered by a traditional step stool, including the ability of a child to gain access to items that are otherwise out of reach. Custom animal and character covers may be original works of sculpture in the visual arts protected by copyright, and the trade names given to the decorative step stool cover (200), such as Step Up Pets™, may be protected by trademark.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. For example, the step stool (200) may vary in height, area of the planar step surface, or step shape (square, round oval, rectangular etc.). As another example, the planar step surface of the stool (200) may be covered with anti-skid material to minimize slippage between the step stool surface and the inside of the decorative cover (100). As previously noted, the fabric hook and loop fastener (8), such as Velcro® fasteners, may be replaced by another fastener such as one or more zippers, clips, or snaps to close the top cover flap (6) onto the cover bottom (5) and forming the seams (7, 10). The top cover flap (6) may close from right to left or from left to right and may vary in its stuffed appendages.

What is claimed is:

1. A decorative step stool cover, comprising:

a body having a substantially flat top surface, the top surface configured to cover a planar step surface of a single step stool and the body configured to overhang sides of the step stool;

a head attached to a first end of the body;

a tail attached to a second end of the body, opposite the head;

four legs attached to respective corners of the body, each leg comprising a compartment configured to enclose a leg of the step stool and an outside bottom of each leg comprising a skid-resistant material; and means for removably securing the step stool cover to the step stool.

2. The step stool cover of claim 1, wherein:

the body comprises:

a top cover flap;

a cover bottom; and an unfastenable seam securing one end of the top cover flap to a corresponding end of the cover bottom; and the means for removably securing the step stool cover to the step stool comprises:

a first fastener secured to an inside perimeter of the top cover flap; and a second fastener secured to an outside perimeter of the cover bottom and matable to the first fastener.

3. The step stool cover of claim 2, wherein the first and second fasteners comprise strips of hook and loop fastener material.

4. The step stool cover of claim 2, wherein the means for removably securing the step stool cover to the step stool comprises a fastener selected from the group consisting of hook and loop material, snaps, zipper, and clips.

5. The step stool cover of claim 2, wherein at least the top cover flap is an absorptive plush material selected from the group consisting of chenille, silk, rayon, and cotton.

6. The step stool cover of claim 2, wherein an underside of the top cover flap comprises a slip-resistant material.

7. The step stool cover of claim 1, wherein the step stool cover has the appearance of a child-themed character.

8. The step stool cover of claim 1, further comprising a nametag holder secured to the step stool cover.

9. The step stool cover of claim 1, wherein the top surface of the body is approximately 13½ inches wide and approximately 12 inches long and the legs are approximately 9 inches tall.

10. A method of assembling a decorative step stool cover, comprising:

cutting a body top cover flap, having a substantially flat top surface section, out of a first material, the top cover flap configured to cover a planar step surface of a single step stool and overhang sides of the step stool;

cutting a cover bottom section out of a second material;

forming a head section;

forming a tail section;

forming four legs, each leg comprising a compartment configured to enclose a leg of the step stool;

forming an unfastenable seam between a portion of the perimeter of the top cover flap and a corresponding portion of the perimeter of the bottom section;

securing the head section to a first end of the flat top surface section of the top cover flap;

securing the tail section to a second end of the flat top surface section of the top cover flap opposite the first end;

securing the four legs to respective corners of the bottom section; and securing means for creating a fastenable seam to remaining portions of the perimeters of the top cover flap and the bottom section.

11. The method of claim 10, wherein securing the means for creating the fastenable seam comprise securing strips of hook and loop fastener material to the remaining portions of the perimeters of the top cover flap and the bottom section.

12. The method of claim 10, wherein securing the means for forming the fastenable seam comprise securing fasteners selected from the group consisting of hook and loop material, snaps, zipper, and clips to the remaining portions of the perimeters of the top cover flap and the bottom section.

13. The method of claim 10, wherein the first material is an absorptive plush material selected from the group consisting of chenille, silk, rayon, and cotton.

14. The method of claim 10, wherein the assembled decorative step stool cover has the appearance of a child-themed character.

15. The method of claim 10, wherein forming the four legs comprises forming outside bottoms of the four legs with a skid-resistant material.

16. The method of claim 10, further comprising securing a nametag holder to the decorative step stool cover.

17. The method of claim 10, wherein the underside of the first material comprises a slip-resistant material.

18. A decorative step stool cover, comprising:

a body having a substantially flat top surface, the top surface configured to cover a planar step surface of a single step stool and the body configured to overhang sides of the step stool, the body comprising:

a top cover flap;

a cover bottom; and an unfastenable seam securing one end of the top cover flap to a corresponding end of the cover bottom;

a head attached to a first end of the body;

a tail attached to a second end of the body, opposite the head;

four legs attached to respective corners of the body, each leg comprising a compartment configured to enclose a leg of the step stool; and means for removably securing the step stool cover to the step stool, comprising:

a first fastener secured to an inside perimeter of the top cover flap; and a second fastener secured to an outside perimeter of the cover bottom and matable to the first fastener.

19. The step stool cover of claim 18, wherein an outside bottom of each leg comprises a skid-resistant material.

* * * * *